US007667170B2

(12) United States Patent
Jang et al.

(10) Patent No.: US 7,667,170 B2
(45) Date of Patent: Feb. 23, 2010

(54) BACKLIGHT UNIT AND DISPLAY DEVICE HAVING THE SAME

(75) Inventors: Hyun Woo Jang, Seoul (KR); Jae Jung Han, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 11/966,867

(22) Filed: Dec. 28, 2007

(65) Prior Publication Data

US 2008/0258046 A1 Oct. 23, 2008

(30) Foreign Application Priority Data

Apr. 17, 2007 (KR) ..... 10-2007-0037232

(51) Int. Cl.
*H05B 37/02* (2006.01)

(52) U.S. Cl. ..... 250/205; 250/226; 250/214 AL

(58) Field of Classification Search ..... 250/205, 250/226, 214 AL; 345/270, 690, 63, 102; 349/61, 65

See application file for complete search history.

(56) References Cited

U.S. PATENT DOCUMENTS 6,447,132 B1 * 9/2002 Harter, Jr. ..... 362/29
6,795,137 B1 * 9/2004 Whitted et al. ..... 349/68
6,888,528 B2 * 5/2005 Rai et al. ..... 345/102
7,213,955 B1 * 5/2007 Ladouceur et al. ..... 362/557
7,423,626 B2 * 9/2008 Yamamoto et al. ..... 345/102
2002/0159002 A1 * 10/2002 Chang ..... 349/61

* cited by examiner

*Primary Examiner*—Georgia Y Epps
*Assistant Examiner*—Tony Ko
(74) *Attorney, Agent, or Firm*—Birch, Stewart, Kolasch & Birch, LLP

(57) ABSTRACT

Provided are a backlight unit and a display device having the same. The display device according to an embodiment includes a display panel and a backlight unit for supplying light to the display panel. The backlight unit according to an embodiment includes a light guide plate, a light source disposed at a side of the light guide plate, a sensor sensing brightness or color temperature of natural light, an adaptive controller generating a voltage level signal to compensate for the brightness or color temperature of natural light, and a light source driver supplying a voltage corresponding to the voltage level signal to the light source. Thus, although the brightness or the color temperature of the natural light varies, uniform brightness or color temperature can be achieved by adjusting the brightness or the color temperature of the artificial light generated from the light source, thus displaying high-definition and high-quality images.

14 Claims, 10 Drawing Sheets

148

| DIFFERENCE | VOLTAGE LEVEL SIGNAL |
|---|---|
| $LD_1$ | $V_1$ |
| $LD_2$ | $V_2$ |
| $LD_3$ | $V_3$ |
| $LD_4$ | $V_4$ |

248

| VOLTAGE DIFFERENCE | RED LIGHT SOURCE | GREEN LIGHT SOURCE | BLUE LIGHT SOURCE |
|---|---|---|---|
| $CD_1$ | $V_1$ | $V_2$ | $V_3$ |
| $CD_2$ | $V_4$ | $V_5$ | $V_6$ |
| $CD_3$ | $V_7$ | $V_8$ | $V_9$ |
| $CD_4$ | $V_{10}$ | $V_{11}$ | $V_{12}$ |

BACKLIGHT UNIT AND DISPLAY DEVICE HAVING THE SAME

CROSS-REFERENCE TO RELATED APPLICATIONS

The present application claims priority under 35 U.S.C. 119 to Korean Patent Application No. 10-2007-0037232 filed on Apr. 17, 2007, which is hereby incorporated by reference in its entirety.

BACKGROUND

The present invention relates to a backlight unit using natural light and artificial light, and a display device having the same.

Recently, display devices for displaying a large amount of data are under development.

Display devices include a liquid display (LCD) device, an organic electroluminescent display device and a plasma display panel. Among them, a LCD device gradually expands its application area thanks to its characteristics of lightweight, slim profile, low power consumption and full-color moving picture. For example, an LCD device may be used for a mobile phone, a navigation system, a potable multimedia player (PMP), a monitor, a TV, and so forth.

The LCD device displays an image by controlling light transmittance. Since the LCD device is not a self-emission type display device, the LCD device essentially requires a light source such as backlight unit for artificially generating light. A light source used in the backlight unit may include a light emitting diode (LED), a cold cathode fluorescent lamp (CCFL), an external electrode fluorescent lamp (EEFL) or a flat fluorescent lamp (FFL).

SUMMARY

Accordingly, the present invention is directed to a display device that substantially obviates one or more of the problems due to limitations and disadvantages of the related art.

Embodiments provide a backlight unit that is actively responsive to brightness variation of natural light to emit light with uniform brightness, and a display device having the same.

Embodiments also provide a backlight unit that is actively responsive to color temperature variation of natural light to emit light with uniform color temperature, and a display device having the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

In one embodiment, a backlight unit includes: a light guide plate; a light source disposed at a side of the light guide plate, and configured to generate artificial light; a sensor configured to sense brightness of natural light incident on the light guide plate; an adaptive controller configured to generate a voltage level signal to compensate for a brightness difference between the brightness of the natural light and a reference brightness; and a light source driver configured to supply a voltage corresponding to the voltage level signal to the light source.

In another embodiment, a backlight unit includes: a light guide plate; light sources disposed at a side of the light guide plate, and including red, green and blue light sources configured to respectively generate red, green and blue light as artificial light; a sensor configured to sense color temperature of natural light incident on the light guide plate; an adaptive controller configured to generate a first voltage level signal for the red light source, a second voltage level signal for the green light source, and a third voltage level signal for the blue light source, so as to compensate for a color temperature difference between the color temperature of the natural light and a reference color temperature; and a light source driver configured to supply first through third voltages corresponding to the first through third voltage level signals to the red, green and blue light sources, respectively.

In a further embodiment, a display device includes: a display panel disposed on a transparent support member; a backlight unit interposed between the support member and the display panel; and a frame disposed on edges of the display panel and the backlight unit to fix the display panel and the backlight unit. Herein, the backlight unit includes: a light guide plate interposed between the support member and the display panel; a light source disposed at a side of the light guide plate, and configured to generate artificial light; a sensor configured to sense brightness of natural light incident on the light guide plate; an adaptive controller configured to generate a voltage level signal to compensate for a brightness difference between the brightness of the natural light and a reference brightness; and a light source driver configured to supply a voltage corresponding to the voltage level signal to the light source.

In a still further embodiment, a display device includes: a display panel disposed on a transparent support member; a backlight unit interposed between the support member and the display panel; and a frame disposed on edges of the display panel and the backlight unit to fix the display panel and the backlight unit. Herein, the backlight unit includes: a light guide plate interposed between the support member and the display panel; light sources disposed at a side of the light guide plate, and including red, green and blue light sources configured to respectively generate red, green and blue light as artificial light; a sensor configured to sense color temperature of natural light incident on the light guide plate; an adaptive controller configured to generate a first voltage level signal for the red light source, a second voltage level signal for the green light source, and a third voltage level signal for the blue light source, so as to compensate for a color temperature difference between the color temperature of the natural light and a reference color temperature; and a light source driver configured to supply first through third voltages corresponding to the first through third voltage level signals to the red, green and blue light sources, respectively.

It is to be understood that both the foregoing general description and the following detailed description of the present invention are exemplary and explanatory, and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention, in which.

DETAILED DESCRIPTION OF THE EMBODIMENTS

Reference will now be made in detail to the embodiments of the present invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 1:
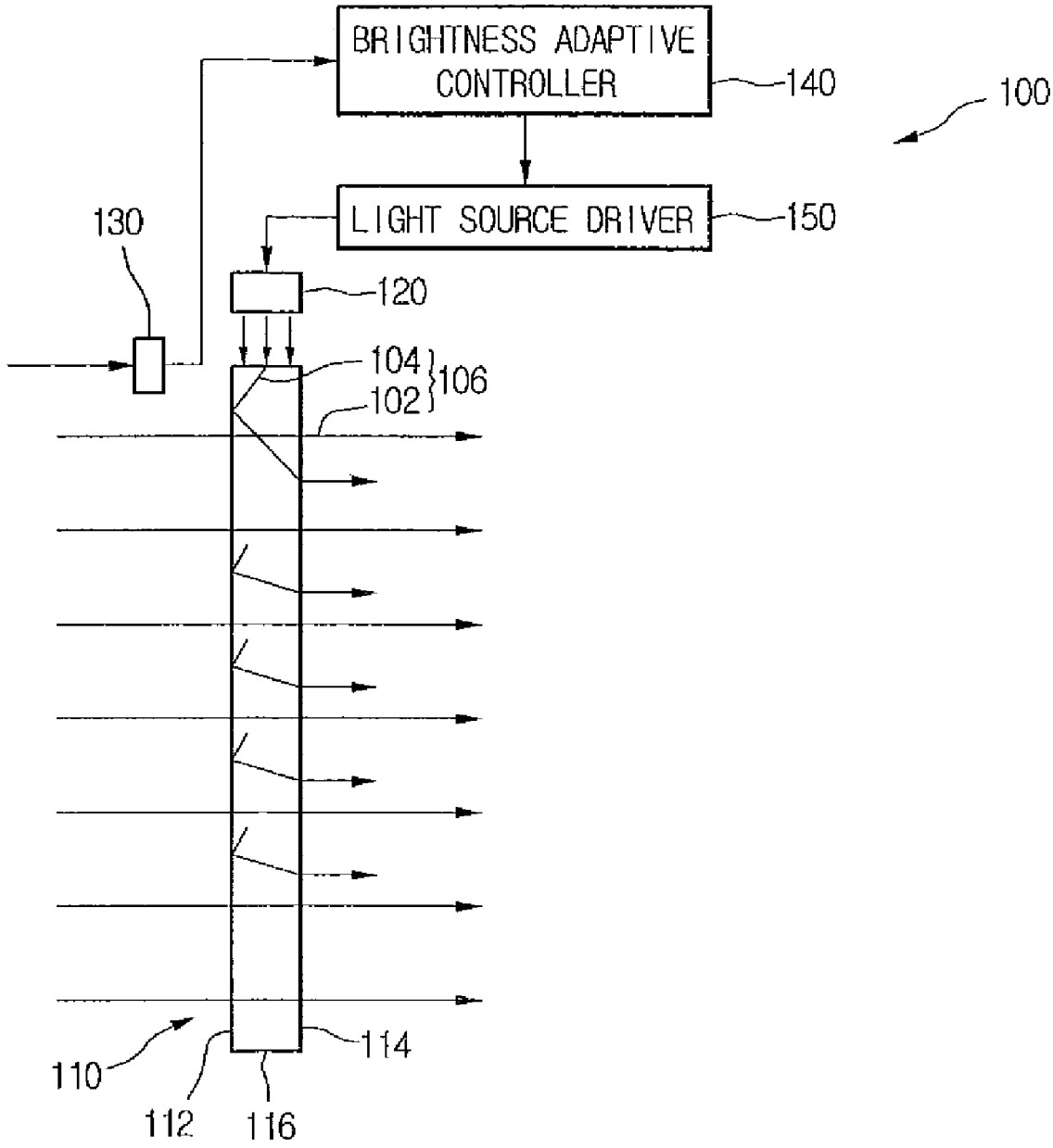
FIG. 1 is a sectional view of a backlight unit according to a first embodiment.

FIG. 1 is a sectional view of a backlight unit according to a first embodiment.

Referring to FIG. 1, the backlight unit 100 includes a light guide plate 110, a light source 120, a sensor 130, a brightness adaptive controller 140 and a light source driver 150.

The light guide plate 110 has the shape of, for example, a rectangular parallelepiped plate. That is, the light guide plate 110 has a first surface 112, a second surface 114 and four sides 116.

The light guide plate 110 improves optical distribution of light. For instance, the light guide plate 110 improves optical distribution of light generated from a point light source such as a light emitting diode (LED) or a line light source such as a cold cathode fluorescent lamp (CCFL). The light guide plate 110 may be formed of, for example, poly methyl methacrylate (PMMA).

Natural light 102 such as sunlight passes through the light guide plate 110. The natural light 102 is incident on the first surface 112 of the light guide plate 110 and emitted through the second surface 114. Generally, brightness of the sunlight varies depending on several conditions such as day or night, season, and latitude. Therefore, brightness variation must be compensated because it is impossible to obtain the natural light, e.g., sunlight, with uniform brightness. While the more higher brightness of the natural light, the better display quality can be obtained.

This embodiment is thus characterized in that the brightness variation of the natural light is compensated by artificial light.

Artificial light 104 generated from the light source 120 is incident on one of the sides 116 and emitted through the second surface 114.

The light source 120 is disposed at the side 116 of the light guide plate 110 and configured to supply the artificial light 104 to the light guide plate 110. The light source 120 may be disposed at one or more sides 116 of the light guide plate 110.

The light source 120 may include, for example, an LED or a CCFL. The light source 120 generates white light similar to the natural light.

The light source 120 can generate light with different brightness levels corresponding to voltage levels supplied from the light source driver 150.

The sensor 130 is configured to sense brightness of the natural light 102 to generate a sensing signal. The sensor 130 may include, for example, an illumination sensor.

The brightness adaptive controller 140 is configured to generate a voltage level signal to compensate for a brightness difference between the brightness of the natural light 102 and reference brightness by using the light source 120. The reference brightness denotes a brightness level set in a display panel.

The brightness adaptive controller 140 is configured to compensate for a brightness difference of the natural light 102 by the corresponding amount of the artificial light 104 generated from the light source 120 when the brightness of the natural light 102 is smaller than the reference brightness. If the brightness of the natural light is higher than the brightness set in the display panel, the light source 120 may be shut down. As a result, mixed light 106 in which the natural light 102 and the artificial light 104 passing through the light guide plate 110 are mixed together can have the same brightness level as the reference brightness. Accordingly, it is possible to obtain the brightness set in the display panel, whereby high-definition and high-quality image can be displayed.

Figure 2:
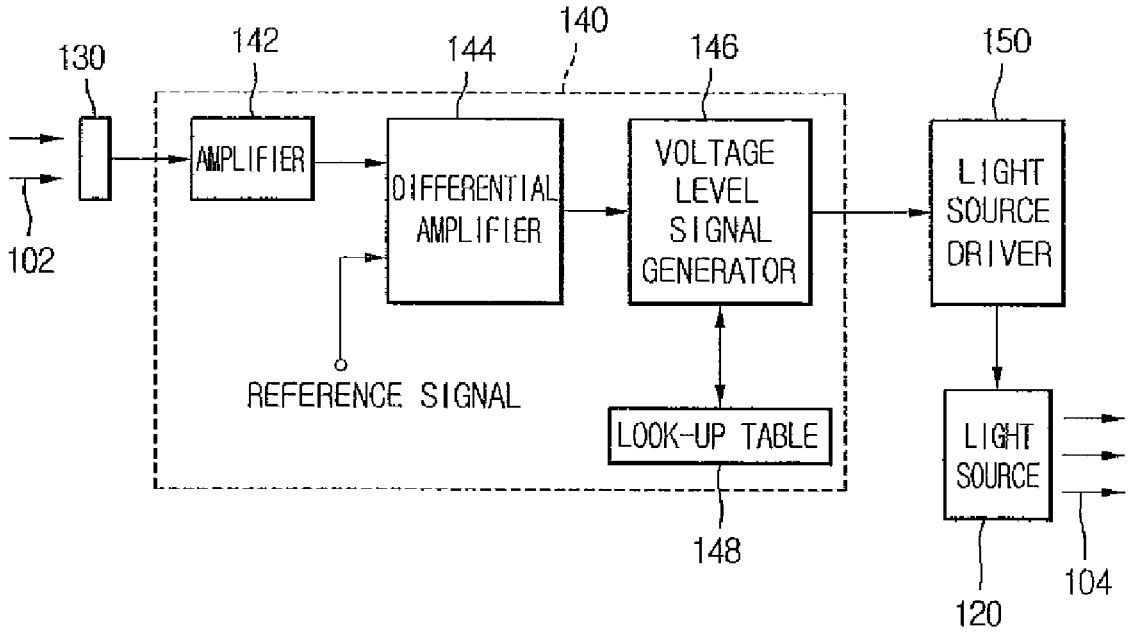
FIG. 2 is a block diagram illustrating a brightness adaptive controller in the backlight unit of FIG. 1.

FIG. 2 is a block diagram illustrating the brightness adaptive controller in the backlight unit of FIG. 1.

Referring to FIG. 2, the brightness adaptive controller 140 includes an amplifier 142, a differential amplifier 144, a voltage level signal generator 146 and a look-up table 148.

The amplifier 142 is configured to amplify the sensing signal supplied from the sensor 130. The amplifier 142 is necessary to be provided if the sensing signal of the sensor 130 is very weak. However, if the sensing signal is strong, the amplifier 142 may be omitted from the brightness adaptive controller 140.

The differential amplifier 144 is configured to receive the sensing signal supplied from the amplifier 142 and a reference signal to amplify a brightness difference signal between the sensing signal and the reference signal. Herein, the sensing signal and the reference signal are brightness signals.

Figures 3, 4:
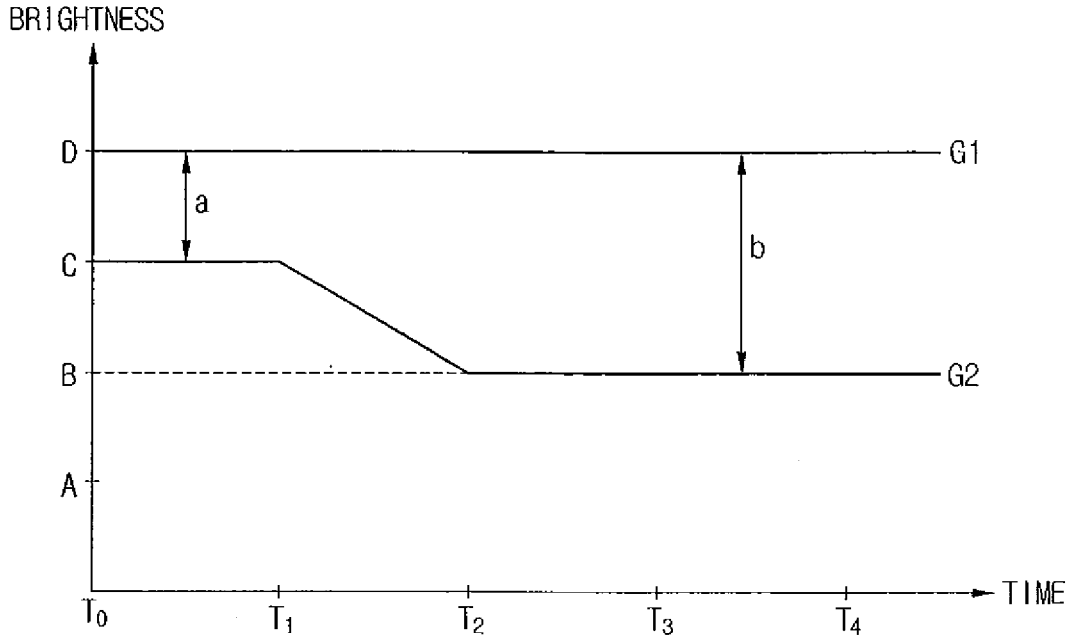
FIG. 3 is a graph illustrating an example of brightness of natural light versus a time.
FIG. 4 is a view illustrating an example of a look-up table of the brightness adaptive controller of FIG. 2.

FIG. 3 is a graph illustrating brightness of natural light versus a time.

In FIG. 3, a line G1 denotes the reference signal, and a line G2 denotes a brightness variation of the natural light sensed by the sensor 130 with the lapse of a time. An X-axis represents a time and a Y-axis represents a brightness level.

Referring to FIG. 3, the natural light has a brightness level C during a period from a point T0 to a point T1, and a brightness level B during a period from a point T2 to a point T4. The brightness of the natural light becomes lower in the period from the point T2 to the point T4 than the period from the point T0 to the point T1.

From the lines G1 and G2 of FIG. 3, it can be understood that a brightness difference between the reference brightness and the brightness of the natural light is 'a' during the period from the point T0 to the point T1, and a brightness difference between the reference brightness and the brightness of the natural light is 'b' during the period from the point T2 to the point T4. The brightness difference 'a' during the period from the point T0 to the point T1 is smaller than the brightness difference 'b' during period from the point T2 to the point T4.

Referring back to FIG. 2, the voltage level signal generator 146 is configured to select a voltage level signal corresponding to the brightness difference signal between the reference signal and the sensing signal, and outputs the selected voltage level signal.

FIG. 4 is a view illustrating a look-up table 148 of the brightness adaptive controller 140 of FIG. 2.

A range of each brightness difference and voltage level signals according to the range of the brightness difference are stored in the look-up table 148. Therefore, the voltage level signal generator 146 may select, for example, a voltage level signal corresponding to the range of the brightness difference signal including the brightness difference signal between the reference signal and the sensing signal from the look-up table 148 where the voltage level signals according to the range of the brightness difference signal are stored.

According to the look-up table 148 of FIG. 4, a voltage level signal is V1 when a brightness difference range is 'LD1', a voltage level signal is V2 when a brightness difference range is 'LD2', a voltage level signal is V3 when a brightness difference range is 'LD3', and a voltage level signal is V4 when a brightness difference range is 'LD4'

The brightness difference 'a' of FIG. 3 may be included in the brightness difference range LD1 of FIG. 4, and the brightness difference 'b' of FIG. 3 may be included in the brightness difference range LD3 of FIG. 4.

Referring to FIGS. 2 to 4, when the brightness difference signal 'a', for example, is supplied to the voltage level signal generator 146, the voltage level signal generator 146 selects the voltage level signal V1 corresponding to the brightness difference range LD1 including the brightness difference signal 'a' from the look-up table 148 to supply the selected voltage level signal V1 to the light source driver 150.

When the brightness difference signal 'b' is supplied to the voltage level signal generator 146 from the differential amplifier 144, the voltage level signal generator 146 selects the voltage level signal V3 corresponding to the brightness difference range LD3 including the brightness difference signal 'b' from the look-up table 148 to supply the selected voltage level signal V3 to the light source driver 150.

Figure 5:
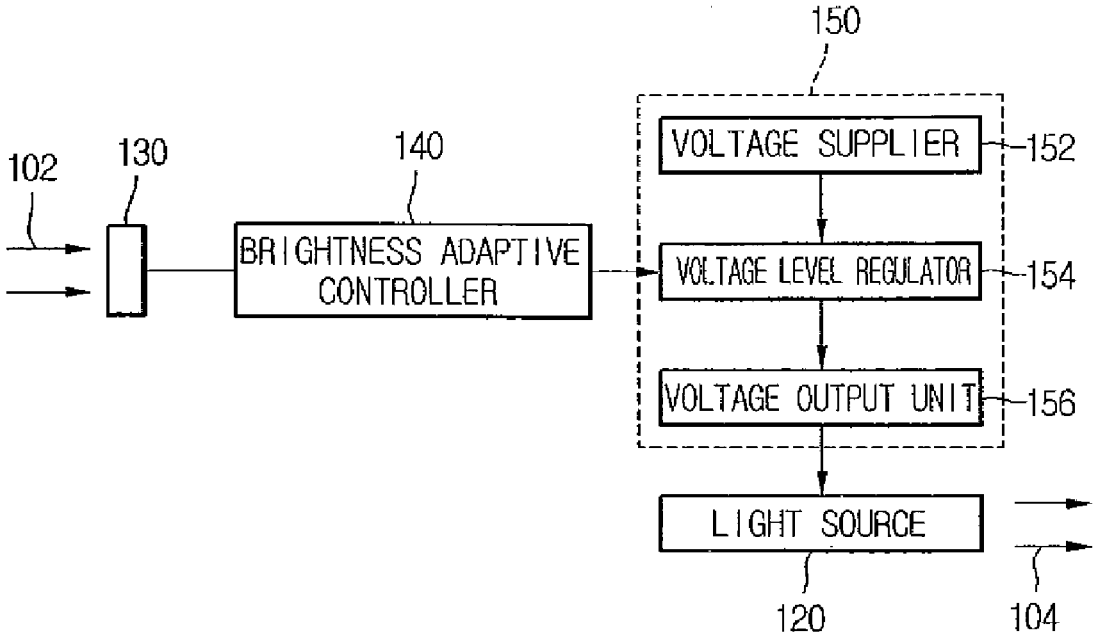
FIG. 5 is a block diagram of a light source driver in the backlight unit of FIG. 1.

FIG. 5 is a block diagram of the light source driver 150 in the backlight unit 100 of FIG. 1.

Referring to FIG. 5, the light source driver 150 regulates a main voltage based on the voltage level signal supplied from the brightness adaptive controller 140 to supply the regulated voltage to the light source 120.

The light source driver 150 includes a voltage supplier 152, a voltage level regulator 154 and a voltage output unit 156.

The voltage supplier 152 is configured to generate a main voltage to supply it to the voltage level regulator 154. The voltage level regulator 154 is configured to regulate the main voltage based on the voltage level signal supplied from the voltage level signal generator 146 of the brightness adaptive controller 140.

For example, when the voltage level signal V1 is supplied from the voltage level signal generator 146 of the brightness adaptive controller 140, the voltage level regulator 154 regulates the main voltage, e.g., 10 V, supplied from the voltage supplier 152 to supply the regulated voltage, e.g., 2 V, to the light source 120. The regulated voltage may be supplied to the light source 120 via the voltage output unit 156. The light source 120 supplies the artificial light 104 corresponding to the regulated voltage to the light guide plate 110.

When the voltage level signal V2 is supplied from the voltage level signal generator 146 of the brightness adaptive controller 140, the voltage level regulator 154 regulates the main voltage, e.g., 10 V, supplied from the voltage supplier 152 to supply the regulated voltage, e.g., 4 V, to the light source 120. The light source 120 supplies the artificial light 104 corresponding to the regulated voltage to the light guide plate 110.

The artificial light 104 supplied from the light guide plate 110 is mixed with the natural light 102 to form the mixed light 106. Therefore, if the brightness of the natural light 102 is degraded, the brightness level set in the display panel can be maintained at a constant level by increasing the brightness of the artificial light 104. The brightness of the mixed light 106 is substantially equal to the brightness corresponding to the reference signal or the brightness set in the display panel.

As the brightness difference between the natural light and the reference signal becomes greater, a higher voltage should be supplied to the light source 120 generating the artificial light 104. According to this embodiment, since the brightness of the artificial light 104 generated from the light source 120 is increased/decreased to compensate for the brightness variation of the natural light 102, the brightness of the mixed light 106 passing through the light guide plate 110 can be maintained at a constant brightness level set in the display panel even though the brightness of the natural light 102 is varied.

Figure 6:
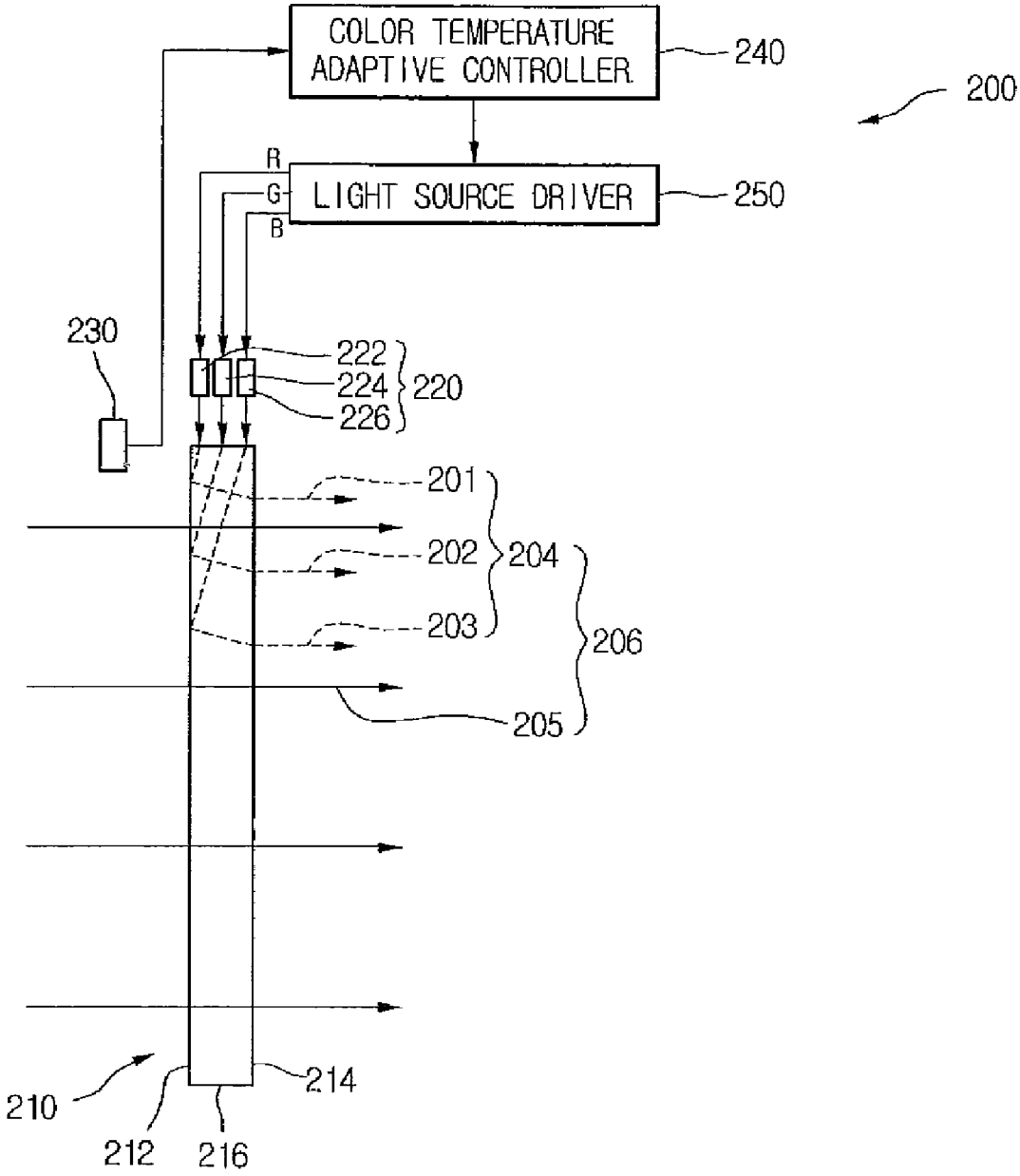
FIG. 6 is a sectional view of a backlight unit according to a second embodiment.

FIG. 6 is a sectional view of a backlight unit 200 according to a second embodiment.

Referring to FIG. 6, the backlight unit 200 includes a light guide plate 210, a light source 220, a sensor 230, a color temperature adaptive controller 240 and a light source driver 250.

The light guide plate 210 has the shape of, for example, a rectangular parallelepiped plate. That is, the light guide plate 210 has a first surface 212, a second surface 214 and four sides 216.

The light guide plate 210 improves optical distribution of light incident thereon. For instance, the light guide plate 210 improves brightness distribution of light generated from a point light source such as an LED or a line light source such as a CCFL.

The light guide plate 210 may be formed of, for example, poly methyl methacrylate (PMMA).

Natural light 205 such as sunlight passes through the light guide plate 210. The natural light 205 is incident on the first surface 212 of the light guide plate 210 and emitted through the second surface 214. Generally, color temperature of the sunlight changes depending on several conditions such as day or night, season, and latitude. Therefore, color temperature variation must be compensated because it is impossible to obtain the natural light, e.g., sunlight, with uniform color temperature.

This embodiment is thus characterized in that the color temperature variation of the natural light is compensated by artificial light.

Artificial light 204 generated from the light source 220 is incident on one of the sides 216 of the light guide plate 210 and emitted through the second surface 214.

The light source 220 is disposed at the side 216 of the light guide plate 210 and configured to supply the artificial light 204 to the light guide plate 210. The light source 220 may be disposed at one or more sides 216 of the light guide plate 210.

The light source 220 may include, for example, a red light source 222 emitting red light 201 having a red wavelength, a green light source 224 emitting green light 202 having a green wavelength, a blue light source 226 emitting blue light 203 having a blue wavelength.

The red light source 222 may include a red LED emitting the red light 201, the green light source 224 may include a green LED emitting the green light 202, and a blue light source 226 may include a blue LED emitting the blue light 203.

Alternatively, the red light source 222 may include a red CCFL emitting the red light 201, the green light source 224 may include a green CCFL emitting the green light 202, and the blue light source 226 may include a blue CCFL emitting the blue light 203.

Each of the light sources 222, 224 and 226 can emit the red light 201, the green light 202 and the blue light 203 having respective color temperatures that correspond to voltage levels supplied from the light source driver 250.

The sensor 230 is configured to sense color temperature of the natural light 205 to generate a sensing signal. The sensor 230 may include, for example, a color sensor capable of sensing the color temperature of the natural light 205.

The color temperature adaptive controller 240 is configured to generate voltage level signals to compensate for a color temperature difference between the color temperature of the natural light 205 sensed by the sensor 230 and reference color temperature by using the light source 220. The reference color temperature denotes a color temperature of the natural light, i.e., in the range of approximately 5,500° K to approximately 6,000° K in clear day and midday (hereinafter, also referred to as a standard color temperature).

The color temperature adaptive controller 240 is configured to compensate for a color temperature difference of the natural light 205 by at least one of the red light 201, the green light 202 and the blue light 203 generated from the light source 220 if there is a color temperature difference between the color temperature of the natural light 205 sensed by the sensor 230 and the reference color temperature. As a result, mixed light 206 in which the natural light 205 and the artificial light 204 passing through the light guide plate 210 are mixed together can have the same color temperature as the reference color temperature. Accordingly, the standard color temperature can be achieved, and thus it is possible to display a high-definition and high-quality image.

Figure 7:
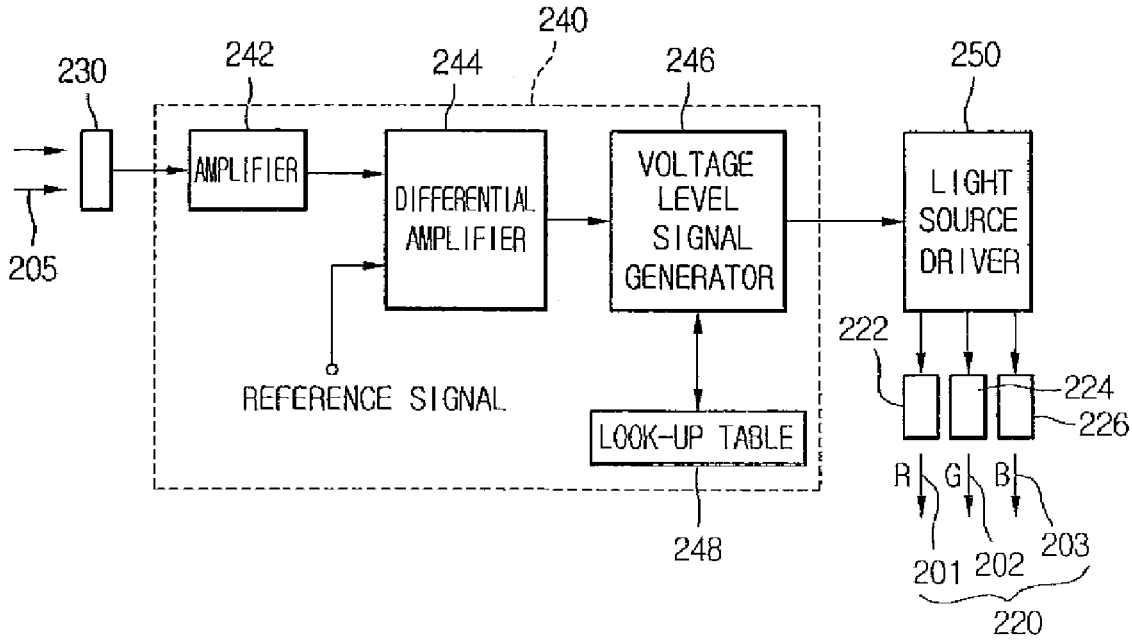
FIG. 7 is a block diagram of a color temperature adaptive controller in the backlight unit of FIG. 6.

FIG. 7 is a block diagram of the color temperature adaptive controller 240 in the backlight unit 200 of FIG. 6.

Referring to FIG. 7, the color temperature adaptive controller 240 includes an amplifier 242, a differential amplifier 244, a voltage level signal generator 246 and a look-up table 248.

The amplifier 242 of the color temperature controller 240 is configured to amplify the sensing signal supplied from the sensor 230.

The differential amplifier 244 receives the sensing signal supplied from the amplifier 242 and a reference signal. Herein, the reference signal denotes the standard color temperature as defined above.

The differential amplifier 244 is configured to amplify a color temperature difference signal between the sensing signal and the reference signal to output the amplified signal. Therefore, the color temperature difference signal outputted from the differential amplifier 244 means the color temperature difference between the color temperature of the natural light 205 sensed by the sensor 230 and the reference color temperature.

Figures 8, 9:
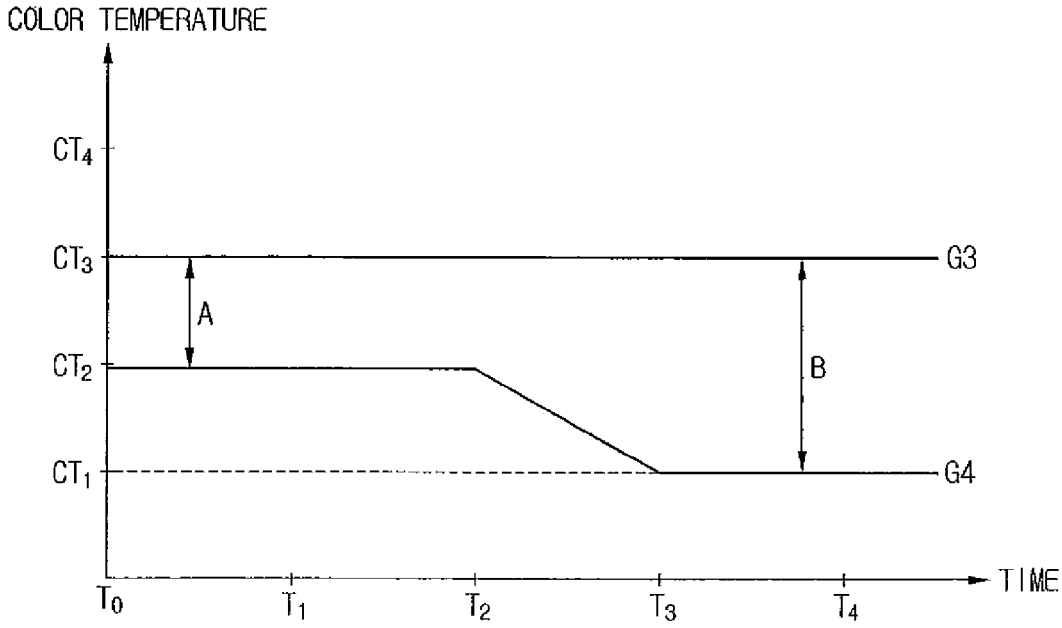
FIG. 8 is a graph illustrating an example of color temperature of natural light versus a time.
FIG. 9 is a view illustrating an example of a look-up table of the color temperature adaptive controller of FIG. 7.

FIG. 8 is a graph illustrating color temperature of natural light versus a time.

In FIG. 8, a line G3 denotes the reference color temperature, and a line G4 denotes a color temperature variation of the natural light sensed by the sensor 230 with the lapse of a time. An X-axis represents a time and a Y-axis represents a color temperature level.

Referring to FIG. 8, the natural light 205 has a color temperature level CT2 during a period from a point T0 to a point T2, and a color temperature level CT1 during a period from a point T3 to a point T4. For example, the natural light 205 having the color temperature level CT2 during the period from the point T0 to the point T2 looks blue, whereas the natural light 205 having the color temperature level CT1 during the period from the point T3 to the point T4 looks red.

From the lines G3 and G4 of FIG. 8, it can be understood that a color temperature difference between the reference color temperature and the color temperature of the natural light 205 is 'A' during the period from the point T0 to the point T2, and a color temperature difference between the reference color temperature and the color temperature of the natural light 205 is 'B' during the period from the point T3 to the point T4. The color temperature difference 'A' during the period from the point T0 to the point T2 is smaller than the color temperature difference 'B' during period from the point T3 to the point T4.

Referring back to FIG. 7, the voltage level signal generator 246 of the color temperature adaptive controller 240 is configured to select a first voltage level signal for the red light source 222, a second voltage level signal for the green light source 224, and a third voltage level signal for the blue light source 226, corresponding to the color temperature difference signal between the reference signal and the sensing signal, and then outputs the selected voltage level signal.

FIG. 9 is a view illustrating a look-up table 248 of the color temperature adaptive controller 240 of FIG. 7.

First through third voltage level signals according to each color temperature difference range are stored in the look-up table 248. Therefore, the voltage level signal generator 246, for example, may select the first through third voltage level signals corresponding to the color temperature difference signal range including the color temperature difference signal between the reference signal and the sensing signal from the look-up table 248 where the first through third voltage level signals corresponding to each color temperature difference range are stored.

According to the look-up table 248 of FIG. 9, for example, when a color temperature difference range is 'CD1', the first voltage level signal for the red light source 222 is V1, the second voltage level signal for the green light source 224 is V2, and the third voltage level signal for the blue light source 226 is V3.

Unlike the above, when a color temperature difference range is 'CD2', the first voltage level signal for the red light source 222 is V4, the second voltage level signal for the green light source 224 is V5, and the third voltage level signal for the blue light source 226 is V6.

The color temperature difference 'A' of FIG. 8 may be included in the color temperature difference range CD1 of FIG. 9, and the color temperature difference 'B' of FIG. 8 may be included in the color temperature difference range CD1 of FIG. 9.

Referring to FIGS. 7 to 9, for example, when the color temperature difference signal 'A' is supplied to the voltage level signal generator 246 from the differential amplifier 244, the voltage level signal generator 246 selects the first voltage level signal V1 for the red light source 222, the second voltage level signal V2 for the green light source 224, and the third voltage level signal V3 for the blue light source 226, corresponding to the color temperature difference range CD1 including the color temperature difference signal 'A' from the look-up table 248, and thereafter supplies the selected voltage level signal to the light source driver 250.

For another example, when the color temperature difference signal 'B' is supplied to the voltage level signal generator 246 from the differential amplifier 244, the voltage level signal generator 246 selects the first voltage level signal V4 for the red light source 222, the second voltage level signal V5 for the green light source 224, and the third voltage level signal V6 for the blue light source 226, corresponding to the color temperature difference range CD2 including the color temperature difference signal 'B' from the look-up table 248, and thereafter supplies the selected voltage level signal to the light source driver 250.

Figure 10:
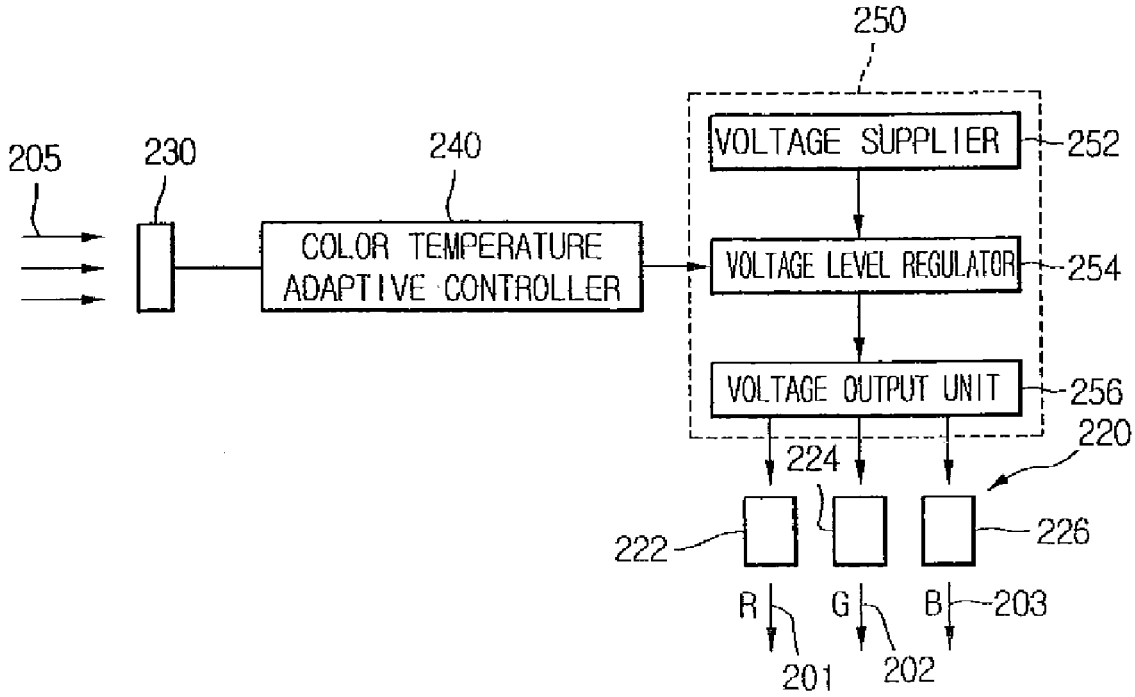
FIG. 10 is a block diagram of a light source driver in the backlight unit of FIG. 6.

FIG. 10 is a block diagram of the light source driver 250 in the backlight unit 200 of FIG. 6.

Referring to FIG. 10, the light source driver 250 regulates a main voltage based on the first through third voltage level signals supplied from the color temperature adaptive controller 240 to supply the regulated voltage to the light source 220.

The light source driver 250 includes a voltage supplier 252, a voltage level regulator 254 and a voltage output unit 256.

The voltage supplier 252 is configured to generate a main voltage to supply it to the voltage level regulator 254. The voltage level regulator 254 is configured to regulate the main voltage based on the first through third voltage level signals supplied from the voltage level signal generator 246 of the color temperature adaptive controller 240.

For example, when the first through third voltage level signals V1, V2 and V3 corresponding to the color temperature difference range CD1 are supplied form the voltage level signal generator 246 of the color temperature adaptive controller 240, the voltage level regulator 254 regulates the main voltage, e.g., 5 V, supplied from the voltage supplier 252 to supply the regulated first voltage, e.g., 1.9 V, to the red light source 222, to supply the regulated second voltage, e.g., 3.1 V, to the green light source 224, and to supply the regulated third voltage, e.g., 3.36 V, to the blue light source 226.

Alternatively, when the first through third voltage level signals V4, V5 and V6 corresponding to the color temperature difference range CD2 are supplied form the voltage level signal generator 246 of the color temperature adaptive controller 240, the voltage level regulator 254 regulates the main voltage, e.g., 5 V, supplied from the voltage supplier 252 to supply the regulated first voltage, e.g., 1.8 V, to the red light source 222, to supply the regulated second voltage, e.g., 3.1 V, to the green light source 224, and to supply the regulated third voltage, e.g., 3.52 V, to the blue light source 226.

To obtain the standard color temperature, it is possible to supply the first voltage of 2 V, the second voltage of 3.1 V and the third voltage of 3.2 V to the red light source 222, the green light source 224 and the blue light source 224, respectively.

As the color temperature difference increases, the first voltage supplied to the red light source 222 becomes lower than the first voltage (2 V) at the standard color temperature but the third voltage supplied to the blue light source 226 becomes higher than the third voltage (3.2 V) at the standard color temperature, while the second voltage supplied to the green light source 224 keeps the second voltage (3.1) at the standard color temperature, thus making it possible to obtain the standard color temperature.

The regulated voltage may be supplied to the light source 120 via the voltage output unit 256.

The artificial light 204 including the red light 201, the green light 202 and the blue light 203 according to the first through third voltages regulated by the red, green and blue light sources 222, 224 and 226 is irradiated onto the light guide plate 210, and is mixed with the natural light so that the mixed light 206 of the natural light 205 and the artificial light 204 is emitted from the light guide plate 210. The mixed light 206 may have the standard color temperature, i.e., the reference color temperature.

According to this embodiment, since the color temperature of the artificial light 204 including the red light 201, the green light 202 and the blue light 203 generated from the red, green and blue light sources 222, 224 and 226 is increased/decreased to compensate for the color temperature variation of the natural light 205, the color temperature of the mixed light 206 passing through the light guide plate 210 can be maintained at the standard color temperature level even though the color temperature of the natural light 205 is varied.

Figure 11:
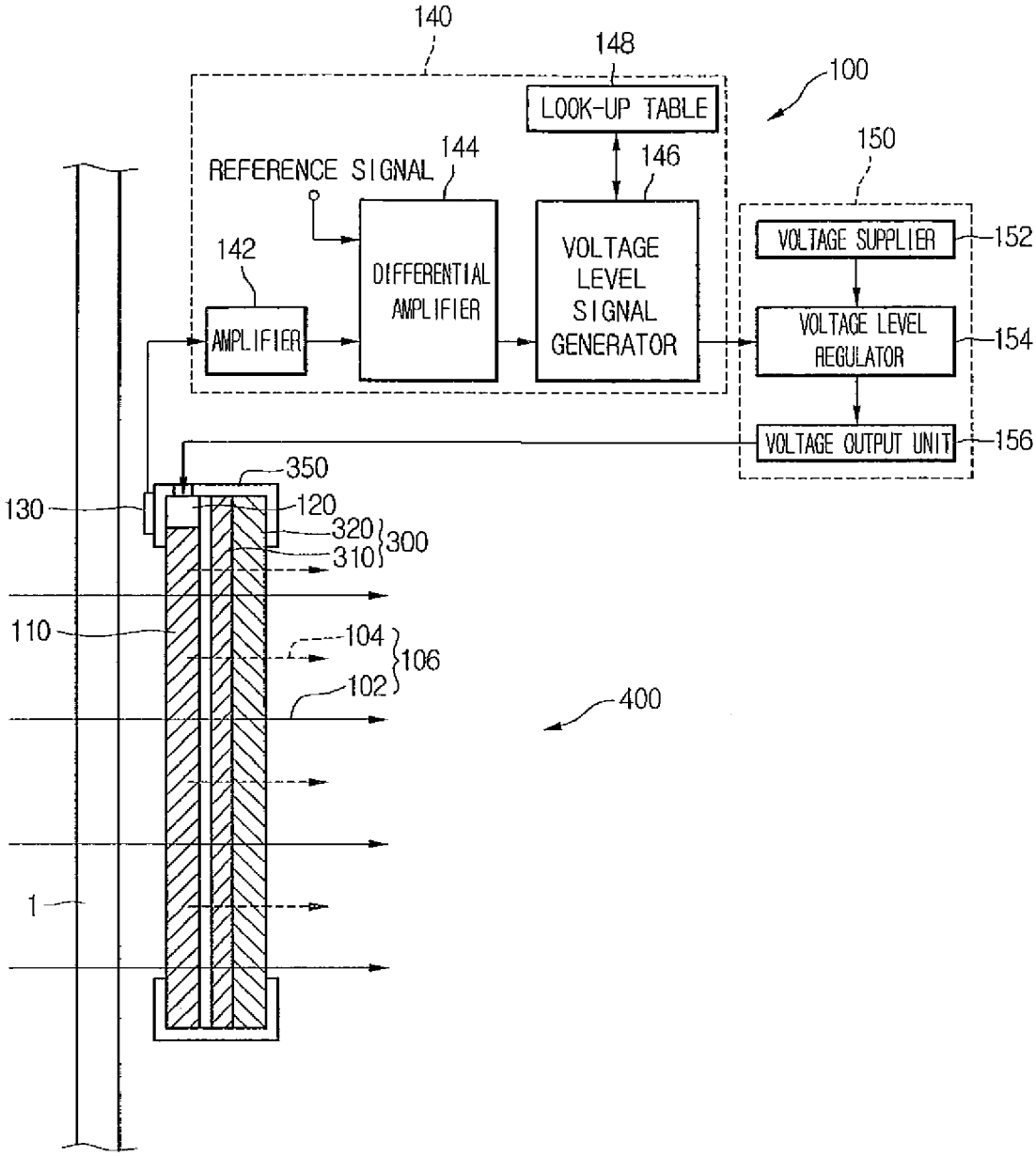
FIG. 11 is a sectional view of a display device according to a third embodiment.

FIG. 11 is a sectional view of a display device 400 according to a third embodiment.

Referring to FIG. 11, the display device 400 includes a backlight unit 100, a liquid crystal panel 300 and a frame 350.

The liquid crystal panel 300 includes a thin film transistor (TFT) substrate 310, a color filter substrate 320 and a liquid crystal layer (not shown). The TFT substrate 310 and the color filter substrate 320 face each other, and the liquid crystal layer is interposed between the TFT substrate 310 and the color filter substrate 320.

The liquid crystal panel 300 is disposed over a transparent support member 1 such as a glass substrate or glass window.

The liquid crystal panel 300 and the backlight unit 100 are received in the frame 350. The frame 350 is disposed along the edges of the liquid crystal panel 300 and the backlight unit 100 to surround them such that the natural light 102 passing through the support member 1 can be incident on the backlight unit 100 and the liquid crystal panel 300. Accordingly, the natural light 102 can be transmitted in a region except for the edges of the backlight unit 100 and the liquid crystal panel 300.

The backlight unit 100 provides light that the liquid crystal panel requires for displaying an image.

The backlight unit 100 includes a light guide plate 110, a light source 120, a sensor 130, a brightness adaptive controller 140 and a light source driver 150.

The sensor 130 is configured to sense the brightness of the natural light 102 to apply a sensing signal to an amplifier 142 of the brightness adaptive controller 140.

The amplifier 142 is configured to amplify the sensing signal to output the amplified sensing signal to a differential amplifier 144.

The differential amplifier 144 is configured to output a brightness difference signal between the sensing signal corresponding to the brightness of the natural light 102 and a reference brightness signal corresponding to the reference brightness, to a voltage level signal generator 146.

The voltage level signal generator 146 is configured to select a voltage level signal from a look-up table 148 based on the brightness difference signal supplied from the differential amplifier 142 to supply the selected voltage level signal to a voltage level regulator 154 of the light source driver 150.

The voltage level regulator 154 is configured to regulate a main voltage supplied from the voltage supplier 152 based on the voltage level signal supplied from the voltage level signal generator 146, and then supply the regulated voltage to the light source 120 disposed at a side of the light guide plate 110 facing the liquid crystal panel 300.

The light source 120 emits the artificial light 104 according to the regulated voltage to the light guide plate 110. Accordingly, the mixed light 106 where the artificial light 104 and the natural light 102 passing through the light guide plate 110 are mixed is supplied to the liquid crystal panel 300, and the liquid crystal panel 300 then displays an image using the mixed light 106. The brightness of the image may be equal to the brightness set in the liquid crystal panel 300.

In this embodiment, the brightness of the artificial light 104 emitted from the light source 120 is adjusted to compensate for the brightness variation of the natural light 102 even though the brightness of the natural light 102 changes depending on surrounding conditions. Hence, this makes it possible to display an image with uniform brightness from the liquid crystal panel 300.

Figure 12:
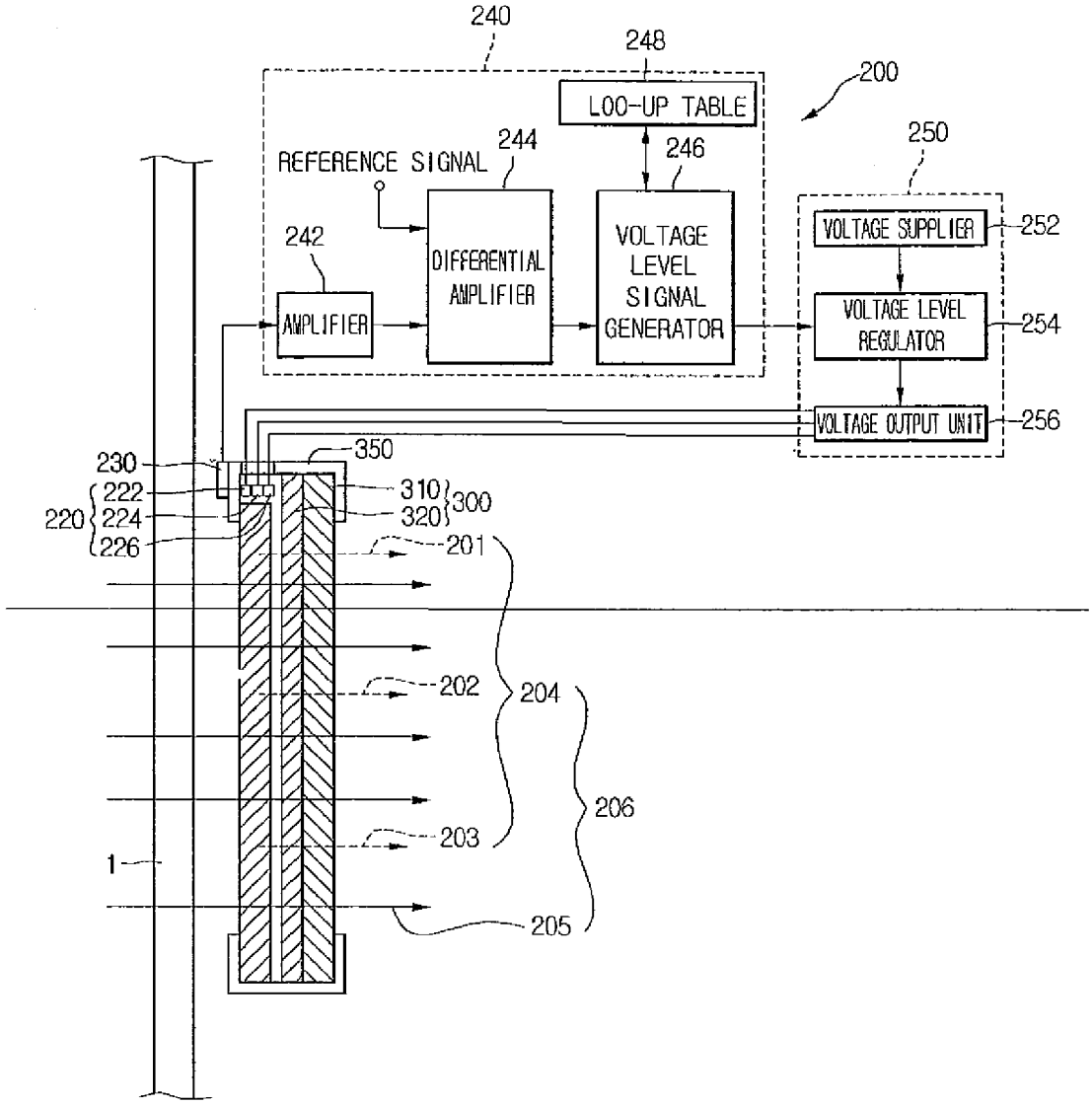
FIG. 12 is a sectional view of a display device according to a fourth embodiment.

FIG. 12 is a sectional view of a display device 400 according to a fourth embodiment.

Referring to FIG. 12, the display device 400 includes a backlight unit 200, a liquid crystal panel 300 and a frame 350.

The liquid crystal panel 300 includes a TFT substrate 310, a color filter substrate 320 and a liquid crystal layer (not shown). The TFT substrate 310 and the color filter substrate 320 face each other, and the liquid crystal layer is interposed between the TFT substrate 310 and the color filter substrate 320.

The liquid crystal panel 300 is disposed over a transparent support member 1 such as a glass substrate or glass window.

The liquid crystal panel 300 and the backlight unit 200 are received in the frame 350. The frame 350 is disposed along the edges of the liquid crystal panel 300 and the backlight unit 200 to surround them such that the natural light 205 passing through the support member 1 can be incident onto the backlight unit 200 and the liquid crystal panel 300. Accordingly, the natural light 205 can be transmitted in a region except for the edges of the backlight unit 200 and the liquid crystal panel 300.

The backlight unit 200 provides light that the liquid crystal panel 300 requires for displaying an image.

The backlight unit 200 includes a light guide plate 210, a light source 220, a sensor 230, a color temperature adaptive controller 240 and a light source driver 250.

The sensor 230 is configured to sense the color temperature of the natural light 205 passing through the transparent support member 1 to apply a sensing signal to an amplifier 242 of the color temperature adaptive controller 240.

The amplifier 242 is configured to amplify the sensing signal and outputs the amplified sensing signal to a differential amplifier 244.

The differential amplifier 244 supplies the color temperature difference signal between the sensing signal corresponding to the color temperature of the natural light 205 and a reference signal corresponding to the reference color temperature to a voltage level signal generator 246.

The voltage level signal generator 246 is configured to select a first voltage level signal for a red light 222, a second voltage level signal for a green light source 224 and a third voltage for a blue light source 226, from a look-up table 248 based on the color temperature difference signal supplied from the differential amplifier 244, thus supplying the selected voltage level signal to a voltage level regulator 254 of the light source driver 250.

The voltage level regulator 254 is configured to regulate a main voltage supplied from the voltage supplier 252 based on the first through third voltage level signals supplied from the voltage level signal generator 246, and then respectively supply the regulated first through third voltages to the red, green and blue light sources 222, 224 and 226 of the light source 220 disposed at a side of the light guide plate 210 facing the liquid crystal panel 300.

The red, green and blue light sources 222, 224 and 226 supply the red light 201, the green light 202 and the blue light 203 according to the first through third voltages to the light guide plate 210, respectively. The red light 201, the green light 202 and the blue light 203 are emitted through the light guide plate 210.

The red light 201, the green light 202 and the blue light 203 passing through the light guide plate 210 are supplied to the liquid crystal panel as the artificial light 204. The artificial light 204 is mixed with the natural light passing through the light guide plate 210 to form mixed light 206. Then, the mixed light 206 is supplied to the liquid crystal panel 300, and the liquid crystal panel 300 then displays an image using the mixed light 206. The color temperature of the image may be equal to the standard color temperature.

In this embodiment, the color temperature of the artificial light including the red light 201, the green light 202 and the blue light 203 generated from the light source 220 is adjusted to compensate for the color temperature variation of the natural light 205 even though the color temperature of the natural light 205 changes depending on surrounding conditions. Hence, this makes it possible to display an image with uniform color temperature from the liquid crystal panel 300.

According to aforementioned embodiments, although the brightness or the color temperature of the natural light is varied, the variation of brightness or color temperature can be compensated using artificial light. Accordingly, uniform brightness or color temperature can be maintained, thus making it possible to display high-definition and high-quality image.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A backlight unit, comprising:

a light guide plate;

a light source disposed at a side of the light guide plate;

a sensor configured to sense brightness of natural light;

an adaptive controller configured to generate a voltage level signal to compensate for a brightness difference between the brightness of the natural light and a reference brightness; and a light source driver configured to supply a voltage corresponding to the voltage level signal to the light source, wherein the light source supply an artificial light having a brightness corresponding to the voltage from the light source driver to the light guide plate, wherein the natural light is incident on a lower surface of the light guide plate;

wherein the artificial light is incident on the side of the light guide plate;

wherein the artificial light supplied from the light guide plate is mixed with the natural light to form a mixed light, wherein the mixed light is emitted from an upper surface of the light guide plate corresponding to a display panel, wherein brightness of the mixed light is equal to the reference brightness.

2. The backlight unit according to claim 1, wherein the adaptive controller comprises:

a first amplifier configured to amplify a sensing signal sensed by the sensor;

a second amplifier configured to output a brightness difference between the brightness of the natural light and the reference brightness; and a voltage level signal generator configured to generate a voltage level signal according to the brightness difference.

3. The backlight unit according to claim 2, further comprising a look-up table in which a range of the brightness difference and a voltage level signal corresponding to the range of the brightness difference are stored.

4. The backlight unit according to claim 3, wherein the voltage level signal generator selects a voltage level signal corresponding to the range of the brightness difference including the brightness difference by using the look-up table.

5. The backlight unit according to claim 1, wherein the light source driver comprises:

a voltage supplier configured to generate a main voltage; and a voltage level regulator configured to regulate the main voltage to the voltage based on the voltage level signal generated from the adaptive controller to supply the regulated voltage to the light source.

6. The backlight unit according to claim 1, wherein the sensor comprises an illumination sensor.

7. A backlight unit, comprising:

a light guide plate;

light sources disposed at a side of the light guide plate, and comprising red, green and blue light sources;

a sensor configured to sense color temperature of natural light;

an adaptive controller configured to generate a first voltage level signal for the red light source, a second voltage level signal for the green light source, and a third voltage level signal for the blue light source, so as to compensate for a color temperature difference between the color temperature of the natural light and a reference color temperature; and a light source driver configured to supply first through third voltages corresponding to the first through third voltage level signals to the red, green and blue light sources, respectively, wherein the red, green and blue light sources supply red, green and blue light as an artificial light having red, green and blue color temperatures corresponding to the first to third voltages from the light source driver to the light guide plate, wherein the natural light is incident on a lower surface of the light guide plate;

wherein the artificial light is incident on the side of the light guide plate;

wherein the artificial light supplied from the light guide plate is mixed with the natural light to form a mixed light, wherein the mixed light is emitted from an upper surface of the light guide plate corresponding to a display panel, wherein brightness of the mixed light is equal to the reference color temperature.

8. The backlight unit according to claim 7, wherein the sensor comprises a color sensor.

9. The backlight unit according to claim 7, wherein the adaptive controller comprises:

a first amplifier configured to amplify a sensing signal sensed by the sensor;

a second amplifier configured to output a color temperature difference between the color temperature of the natural light and the reference color temperature; and a voltage level signal generator configured to generate a voltage level signal according to the color temperature difference.

10. The backlight unit according to claim 9, further comprising a look-up table in which a range of the color temperature difference and first through third voltage level signals corresponding to the range of the color temperature difference are stored.

11. The backlight unit according to claim 10, wherein the voltage level signal generator selects first through third voltage level signals corresponding to the range of the color temperature difference including the color temperature difference by using the look-up table.

12. The backlight unit according to claim 7, wherein the light source driver comprises:

a voltage supplier configured to generate a main voltage; and a voltage level regulator configured to regulate the main voltage to the first through third voltages based on the first through third voltage level signals generated from the adaptive controller to supply the regulated first through third voltages to the red, green and blue light sources, respectively.

13. A display device, comprising:

a display panel disposed on a transparent support member;

a backlight unit interposed between the transparent support member and the display panel; and a frame disposed on edges of the display panel and the backlight unit to fix the display panel and the backlight unit, wherein the backlight unit comprises:

a light guide plate interposed between the transparent support member and the display panel;

a light source disposed at a side of the light guide plate;

a sensor configured to sense brightness of natural light;

an adaptive controller configured to generate a voltage level signal to compensate for a brightness difference between the brightness of the natural light and a reference brightness; and a light source driver configured to supply a voltage corresponding to the voltage level signal to the light source, wherein the light source supply an artificial light having a brightness corresponding to the voltage from the light source driver to the light guide plate, wherein the natural light is incident on a lower surface of the light guide plate;

wherein the artificial light is incident on the side of the light guide plate;

wherein the artificial light supplied from the light guide plate is mixed with the natural light to form a mixed light, wherein the mixed light is emitted from an upper surface of the light guide plate corresponding to a display panel, wherein brightness of the mixed light is equal to the reference brightness.

14. A display device comprising:

a display panel disposed on a transparent support member;

a backlight unit interposed between the transparent support member and the display panel; and a frame disposed on edges of the display panel and the backlight unit to fix the display panel and the backlight unit, wherein the backlight unit comprises:

a light guide plate interposed between the transparent support member and the display panel;

light sources disposed at a side of the light guide plate, and comprising red, green and blue light sources;

a sensor configured to sense color temperature of natural light;

an adaptive controller configured to generate a first voltage level signal for the red light source, a second voltage level signal for the green light source, and a third voltage level signal for the blue light source, so as to compensate for a color temperature difference between the color temperature of the natural light and a reference color temperature; and a light source driver configured to supply first through third voltages corresponding to the first through third voltage level signals to the red, green and blue light sources, respectively, wherein the red, green and blue light sources supply red, green and blue light as an artificial light having red, green and blue color temperatures corresponding to the first to third voltages from the light source driver to the light guide plate, wherein the natural light is incident on a lower surface of the light guide plate;

wherein the artificial light is incident on the side of the light guide plate;

wherein the artificial light supplied from the light guide plate is mixed with the natural light to form a mixed light, wherein the mixed light is emitted from an upper surface of the light guide plate corresponding to a display panel, wherein brightness of the mixed light is equal to the reference color temperature.

* * * * *